US005876117A

United States Patent [19]

Chen

[11] Patent Number: 5,876,117

[45] Date of Patent: Mar. 2, 1999

[54] AGITATOR

[75] Inventor: Yin Chen, Taipei, Taiwan

[73] Assignee: Yueh-Chiao Chen, Taiwan

[21] Appl. No.: 964,406

[22] Filed: Nov. 4, 1997

[51] Int. Cl.[6] ..... B01F 7/08

[52] U.S. Cl. ..... 366/320; 366/293

[58] Field of Search ..... 366/320, 319, 366/321, 324, 310, 292, 293, 295, 343

[56] References Cited

U.S. PATENT DOCUMENTS

| | | | |
|---|---|---|---|
| 1,734,632 | 11/1929 | Merrill | 366/320 |
| 2,761,657 | 9/1956 | Rietz | 366/320 |
| 3,138,167 | 6/1964 | Fisher | 366/320 |
| 3,249,342 | 5/1966 | Mikkelsen | 366/320 |
| 4,057,225 | 11/1977 | Ferree | 366/320 |
| 5,144,892 | 9/1992 | Tupek et al. | 366/320 |
| 5,152,971 | 10/1992 | Bertrand et al. | 366/320 |

FOREIGN PATENT DOCUMENTS

| | | | |
|---|---|---|---|
| 1054811 | 4/1959 | Germany | 366/320 |

*Primary Examiner*—Tony G. Soohoo
*Attorney, Agent, or Firm*—A & J

[57] ABSTRACT

An agitator includes a trough having a first end, a second end, a top, a bottom, an inlet on the top and close to the second end, and an outlet on the bottom and close to the first end, an axle rotatably mounted between the first and second ends of the trough and enclosed with an inner spiral vane, the inner spiral vane being fixedly mounted on the axle and gradually decreased in outer diameter, the inner spiral vane being provided with an edge close to the first end of the trough, and an outer spiral vane enclosing the inner spiral vane and fixedly mounted on the inner spiral vane, the outer spiral vane being opposite to the inner spiral vane in spiral direction, whereby the agitator can be stir a mixture thoroughly and rapidly.

11 Claims, 6 Drawing Sheets

AGITATOR

BACKGROUND OF THE INVENTION

1. Field of the Invention

This invention is related to an agitator and in particular to one which can stir a mixture thoroughly and rapidly.

2. Description of the Prior Art

As shown in FIG. 7, the conventional agitator includes a barrel 30 in which are mounted a series of blades 31. The blades 31 are driven by an electric motor to stir up the mixture in the barrel 30. Nevertheless, the blades 31 are rotated to turn up the mixture in use and so in case of dried mixture, the barrel 30 must be covered with a lid in order to prevent the mixture from floating in the air thereby causing much inconvenience in use. When stirring wet mixture such as concrete or the like, it will take a long time to stir well the mixture as such an agitator can stir only a small amount of the mixture each time thus making it unfit for practical use. Furthermore, the mixture close to the cylindrical surface of the barrel 30 will not be touched by the blades 31 and so the mixture will not be thoroughly agitated.

Therefore, it is an object of the present invention to provide an improved agitator which can obviate and mitigate the above-mentioned drawbacks.

SUMMARY OF THE INVENTION

This invention is related to an improved agitator.

It is the primary object of the present invention to provide an improved agitator which includes a trough having a first end, a second end, a top, a bottom, an inlet on the top and close to the second end, and an outlet on the bottom and close to the first end, an axle rotatably mounted between the first and second ends of the trough and enclosed with an inner spiral vane, the inner spiral vane being fixedly mounted on the axle and gradually decreased in outer diameter, the inner spiral vane being provided with an edge close to the first end of the trough, and an outer spiral vane enclosing the inner spiral vane and fixedly mounted on the inner spiral vane, the outer spiral vane being opposite to the inner spiral vane in spiral direction.

It is another object of the present invention to provide an improved agitator which can stir a mixture thorough and rapidly.

It is still another object of the present invention to provide an improved agitator which is simple in construction.

It is still another object of the present invention to provide an improved agitator which is low in cost.

It is a further object of the present invention to provide an improved agitator which is easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
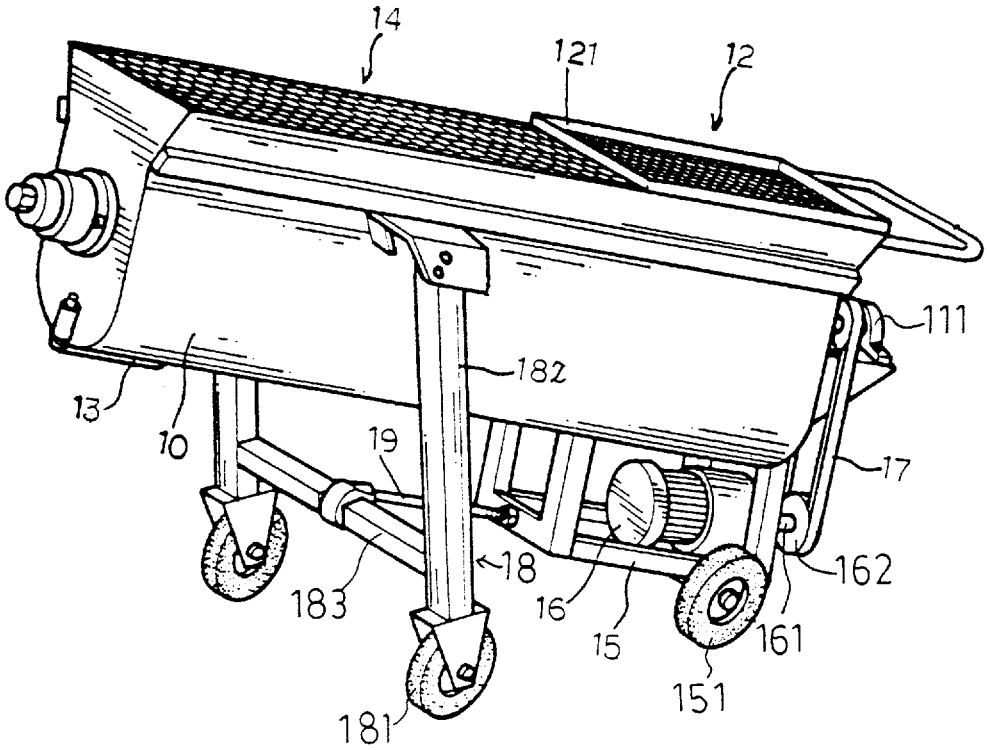
FIG. 1 is a perspective view of an agitator according to the present invention.
Figure 3:
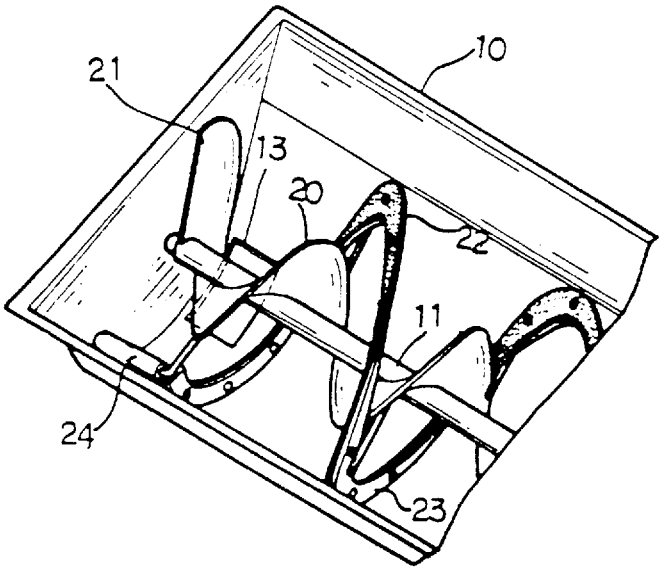
FIG. 3 illustrates the connection between the axle and the front end of the trough.
Figure 2:
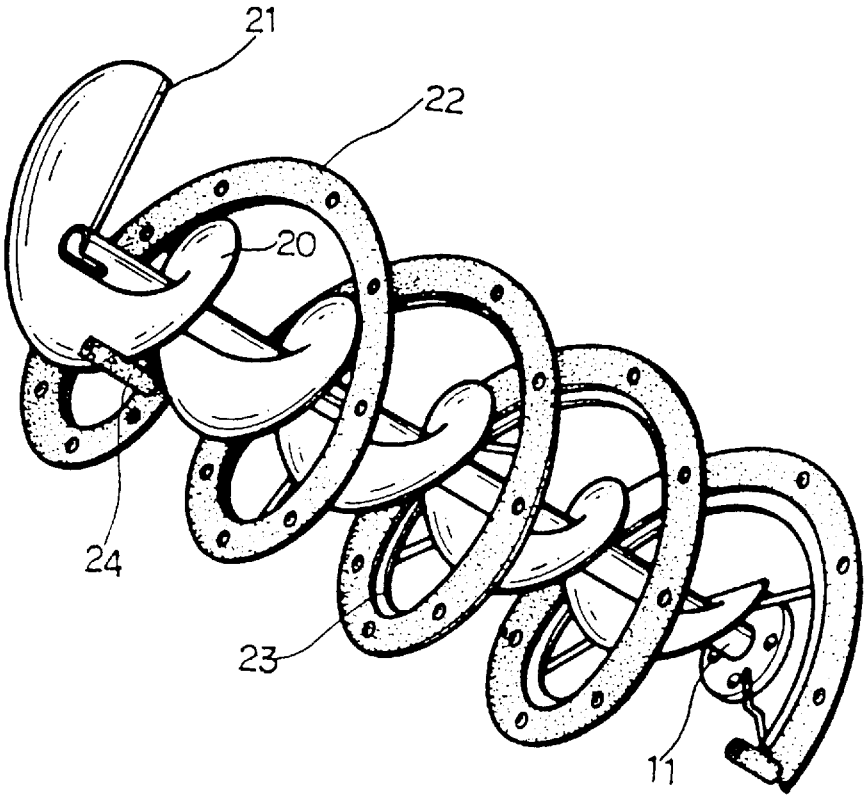
FIG. 2 illustrates the structure of the blades of the agitator.
Figure 4:
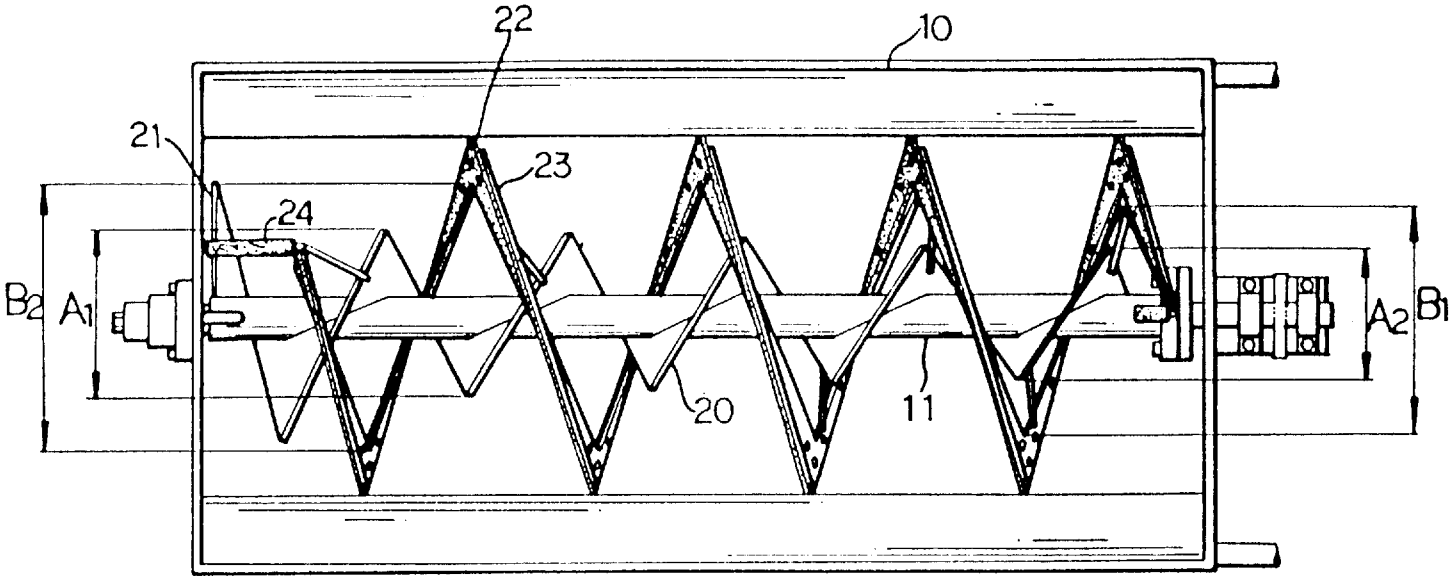
FIG. 4 is a top view of the agitator.
Figure 5:
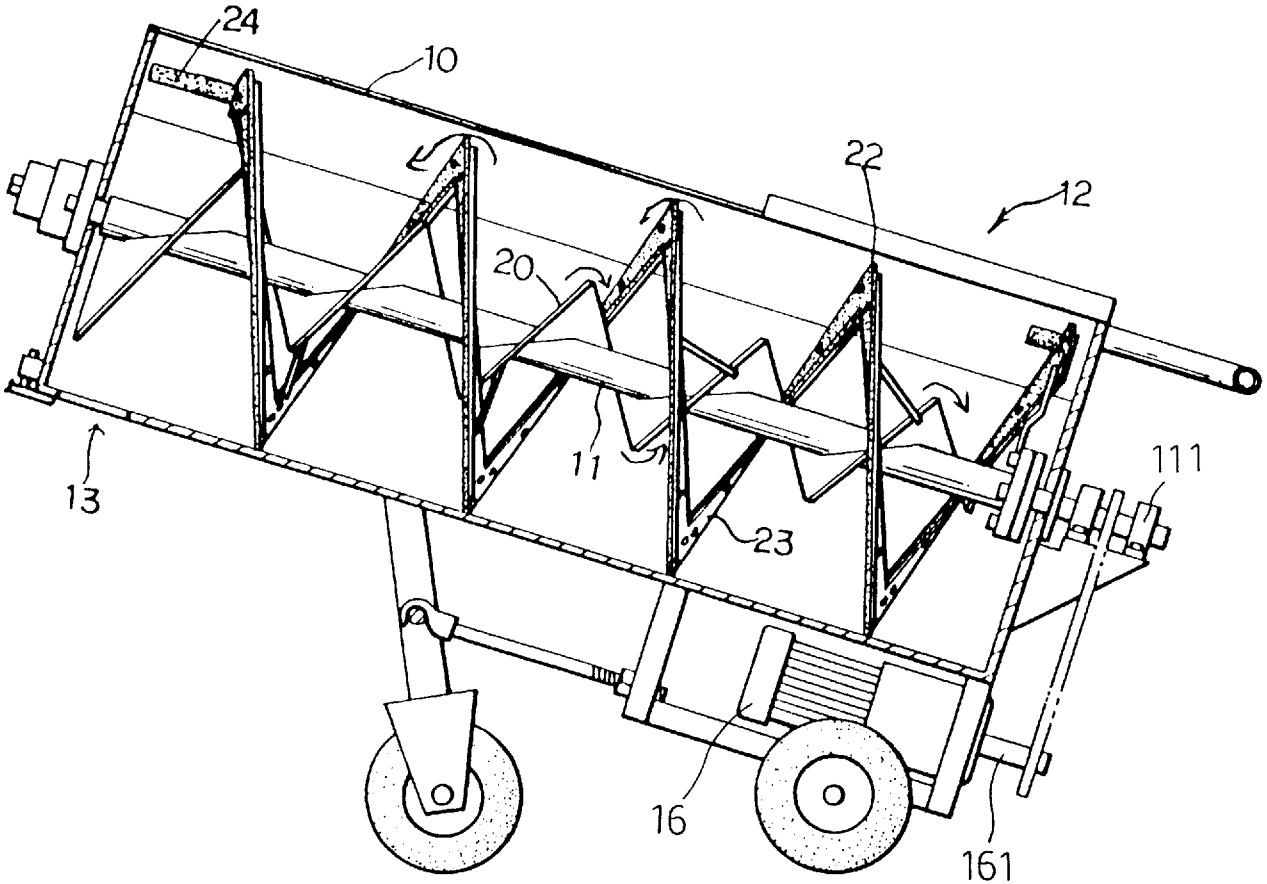
FIG. 5 is a sectional side view of the agitator.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 1, 2, 3, 4 and 5, the agitator according to the present invention generally comprises a trough 10 open at the top and a stirrer arranged within the trough 10. A sieve 121 is mounted on the right portion (with respect to FIG. 1) of the top of the trough 10 for serving as an inlet 12. The other portion of the top of the trough 10 is covered with a net 14 for preventing undesirable objects from entering therein. The bottom of the trough 10 is formed with an outlet 13 at the left end (with respect to FIG. 1). A movable baffle 131 is arranged on the bottom of the trough 10 for closing the outlet 13. Under the bottom right portion of the trough 10 there is a mounting 15 on which is installed an electric motor 16. The electric motor 16 has an output axle 161 provided with a pulley 162. The mounting 15 is provided with two wheels 151 at the bottom. A H-shaped supporting frame 18 having two arms 182 and a cross rod 183 connected between the two arms 182 is mounted on the left portion of the trough 10, with the two arms 182 of the former pivotally connected with two sides of the latter. The lower ends of the arms 182 of the H-shaped supporting frame 18 are each provided with a wheel 181. A linking rod 19 is connected between the cross rod 183 of the H-shaped supporting frame 18 and the mounting 15. The linking rod 19 has a threaded portion 191 at an end threadedly engaged with the mounting 15 and a hook portion 192 adapted to engage with the cross rod 183 of the H-shaped supporting frame 18 so that the linking rod 19 can be adjusted in length. The inclination of the trough 10 can be regulated by adjusting the length of the linking rod 19 (see FIGS. 1 and 5).

An axle 11 is journalled between two ends of the trough 10 so that the axle can be freely rotated within therein. The axle 11 has an end extending out of the trough 10 to engage with a pulley 111. The electric motor 16 is drivingly connected with the axle 11 by a belt 17 connecting between the two pulleys 162 and 111 so that when the electric motor 16 is turned on, the axle 16 will be rotated. A left-handed inner spiral vane 20 is welded or otherwise secured to the axle 11 and has an outer diameter gradually decreased from its left end to the right end (with respect tow FIGS. 2 and 4). In other words, the diameter Al is larger than the diameter A2 (see FIG. 4). Further, the left end of the inner spiral vane 20 is provided with an edge 21 close to the inner left end of the trough 10 for scraping the mixture (not shown) thereon. A right-handed outer spiral vane 23 is fitted over the inner spiral vane 20 and welded or otherwise secured to thereto. The inner diameter of the right-handed outer spiral vane 22 is gradually decreased along a direction from its left end to right end. That is, the diameter B2 is equal to the diameter B1 (see FIG. 4). The outer spiral vane 23 is covered with a layer of rubber 22 for preventing the inner surface of the trough 10 from being scratched and reducing noise. The outer spiral vane 23 is preferably slightly larger than the inner spiral vane 20 in pitch. A stirring rod 24 covered with a soft material such as rubber or the like extends in parallel to the axle 11 and outwardly from the left end of the outer spiral vane 23 to contact the inner left end of the trough 10.

Figure 6:
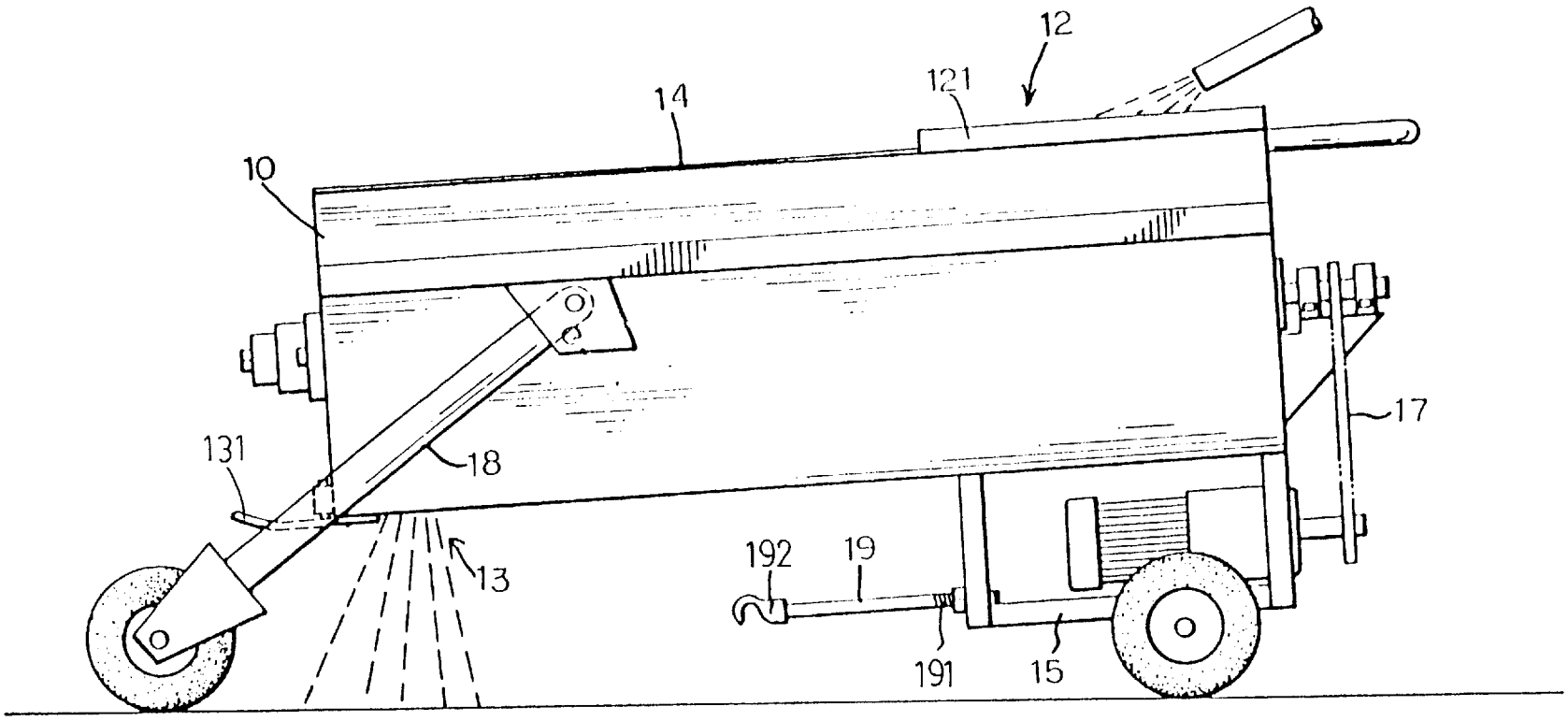
FIG. 6 is a working view of the present invention.
Figure 7:
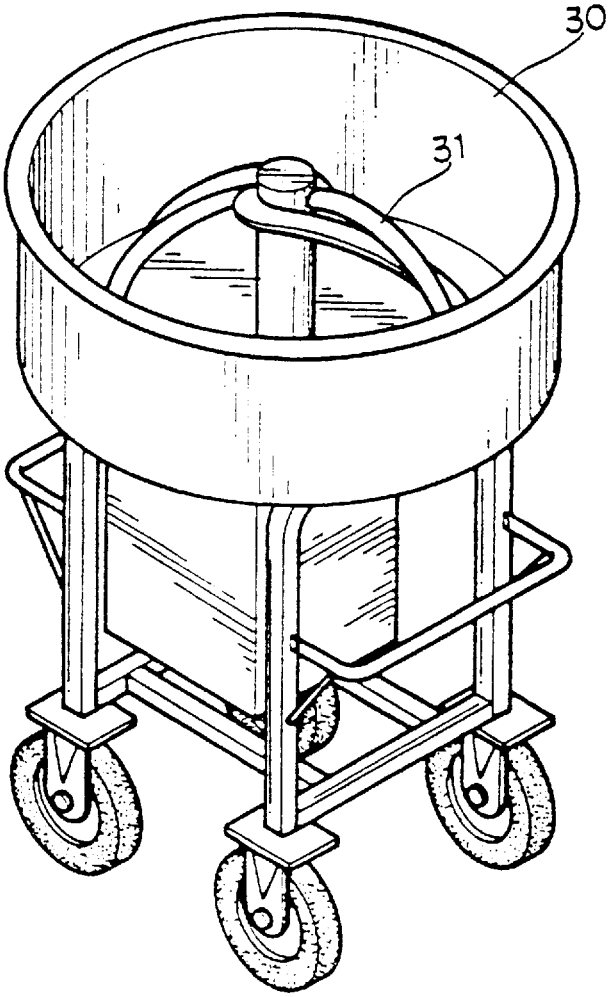
PRIOR ART FIG. 7
FIG. 7 illustrates a prior art agitator.

When in use, a mixture (not shown) is first fed into the trough 10 through the inlet 12 and then the electric motor 16 is turned on to the axle 11 via the belt 17. In the meanwhile, the inner and outer spiral vanes 20 and 23 are rotated simultaneously with the axle 11. As the inner spiral vane 20 is left-handed while the outer spiral vane 23 is right-handed, the mixture will be moved to and from along the axle 11 thereby stirring the mixture thoroughly. Meanwhile, the edge 21 of the inner spiral vane 20 and the stirring rod 24 of the outer spiral vane 23 will scrape the mixture adhered on the inner left end of the trough 10. In addition, the rubber layer 22 covered on the outer spiral vane 23 will scrape the mixture off the inner surface of the trough 10 without causing undesirable noise. As the mixture has been thoroughly stirred, the left end of the trough 10 is lowered and the movable baffle 131 is opened to let it flow out of the outlet 13 of the trough 10 (see FIG. 6).

However, it should be noted that the inner spiral vane 20 and outer spiral vane 23 may be right-handed and left-handed respectively. Furthermore, the outer spiral vane 23 may have a uniform inner diameter, i.e. B2=B1 (see FIG. 4).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A stirrer for an agitator comprising:

an axle;

an inner spiral vane enclosing on said axle and fixedly secured thereto, said inner spiral vane being gradually decreased in outer diameter; and an outer spiral vane enclosing said inner spiral vane and fixedly mounted on said inner spiral vane, said outer spiral vane being opposite to said inner spiral vane in spiral direction.

2. The stirrer for an agitator as claimed in claim 1, wherein said outer spiral vane is gradually increased in inner diameter.

3. The stirrer for an agitator as claimed in claim 1, wherein said outer spiral vane has a uniform inner diameter.

4. The stirrer for an agitator as claimed in claim 1, wherein said outer spiral vane has an end from which extends a stirring rod in parallel to said axle.

5. The stirrer for an agitator as claimed in claim 1, wherein said outer spiral vane is covered with a rubber layer.

6. The stirrer for an agitator as claimed in claim 1, wherein said outer spiral vane is slightly larger than said inner spiral vane in pitch.

7. An agitator comprising:

a trough having a first end, a second end, a top, a bottom, an inlet on said top and close to said second end, and an outlet on said bottom and close to said first end;

an axle rotatably mounted between said first and second ends of said trough and enclosed with an inner spiral vane, said inner spiral vane being fixedly mounted on said axle and gradually decreased in outer diameter, said inner spiral vane being provided with an edge close to said first end of said trough; and an outer spiral vane enclosing said inner spiral vane and fixedly mounted on said inner spiral vane, said outer spiral vane being opposite to said inner spiral vane in spiral direction.

8. The agitator as claimed in claim 7, wherein said axle has an end extending out of said trough, said trough is provided with a H-shaped supporting frame close to said first end of said trough and a mounting close to said second end of said trough, and a motor is arranged on said mounting and drivingly connected with said axle via a belt.

9. The agitator as claimed in claim 7, wherein said top of said trough is provided with a sieve close to said second end of said trough.

10. The agitator as claimed in claim 7, wherein said H-shaped supporting frame is connected with said mounting by a linking rod.

11. The agitator as claimed in claim 7, wherein said top of said trough has is provided with a net.

* * * * *